United States Patent [19]

de Ronde

[11] Patent Number: 4,527,165

[45] Date of Patent: Jul. 2, 1985

[54] MINIATURE HORN ANTENNA ARRAY FOR CIRCULAR POLARIZATION

[75] Inventor: Frans C. de Ronde, Lesigny, France

[73] Assignee: U.S. Philips Corporation, New York, N.Y.

[21] Appl. No.: 471,941

[22] Filed: Mar. 3, 1983

[30] Foreign Application Priority Data

Mar. 12, 1982 [FR] France ..... 82 04252

[51] Int. Cl.[3] ..... H01Q 13/02

[52] U.S. Cl. ..... 343/778; 343/786; 343/797

[58] Field of Search ..... 343/725, 730, 778, 786, 343/797

[56] References Cited

U.S. PATENT DOCUMENTS

| | | | |
|---|---|---|---|
| 3,587,110 | 6/1971 | Woodward | 343/813 |
| 4,263,588 | 4/1981 | Bellee et al. | 343/700 MS |
| 4,486,758 | 12/1984 | de Ronde | 343/700 MS |

*Primary Examiner*—Eli Lieberman

*Attorney, Agent, or Firm*—Robert J. Kraus

[57] ABSTRACT

An antenna for circularly polarized high-frequency signals comprising a succession of layers. An insulating layer 10 includes openings defined by metal plated walls forming miniature horns, each having a square cross-section. A dielectric layer 19 adjacent layer 10 supports a first supply network 20 for signals whose direction of polarization is of a first type of linear polarization. An insulating layer 30 adjacent layer 19 includes openings defined by metal plated walls forming miniature waveguides each having the same square cross-section as a respective horn, at the side facing the first network 20, and having a rectangular cross-section at the other side. A dielectric layer 39 adjacent layer 30 supports a second supply network 40 for signals whose direction of polarization is perpendicular to the polarization of the signals of the first network. An insulating layer 50 adjacent layer 39 includes openings defined by metal plated walls forming miniature waveguides each having the same rectangular cross-section as a respective waveguide in layer 30, at the side facing the second network, and which has a depth smaller than the thickness of the layer 50.

2 Claims, 5 Drawing Figures

MINIATURE HORN ANTENNA ARRAY FOR CIRCULAR POLARIZATION

BACKGROUND OF THE INVENTION

The present invention relates to an antenna element for circularly polarized high-frequency signals, as well as to a planar antenna comprising an array of juxtaposed elements of this type. This invention is used in the field of receiving 12 Gigahertz television signals transmitted by satellites.

A prior French Patent Application filed by Applicants on May 4th, 1981 under No. 81 08 780 and corresponding to U.S. Pat. No. 4,486,758 describes a planar high-frequency antenna formed from receiving elements and having two superimposed plane dielectric layers, each layer having on its outer surface an electrically conductive surface forming a plane and having in each of these conducting surfaces a non-conducting cavity exposing the dielectric layer, these two cavities facing each other. The antenna also has in the median plane between the two plane dielectric layers two distinct striplines, and, optionally, pairs of dipoles arranged in a cross-wise configuration in the same median plane as these networks between the non-conducting cavities. Two strip-line networks, which couple each receiving element to the antenna output, are arranged in one plane. The density of the supply lines, when the number of receiving elements is high, makes it rather difficult to provide them.

SUMMARY OF THE INVENTION

It is an object of the invention to provide a less costly antenna element. To that end, the invention relates to an element for left-hand and right-hand circularly polarized high-frequency signals which element comprises in succession a first insulating layer in which there is provided a miniature horn having a square cross-section and whose inner surface is metal-plated, a first supply network for signals of a first linear polarisation, a second insulating layer in which there is provided a miniature waveguide having a square cross-section at the side facing the first network and a rectangular cross-section at the other side and whose inside surface is metal-plated, a second supply network for signals whose direction of polarization is perpendicular to that of the first network, and a third insulating layer in which there is provided a miniature waveguide having a metal-plated inside surface and the same rectangular cross-section at the side facing the second network and being short-circuited, so that its length is less than the width of this third layer. The invention also relates to an antenna comprising an array of such elements which are arranged side by side as close to each other as possible. With such a structure the antenna thus proposed, while maintaining good efficiency and ensuring satisfactory insulation between the receiving elements, is of a comparatively simple construction, because the supply networks are now distributed over two distinct levels and are consequently less complicated than when they would be provided in one single plane.

BRIEF DESCRIPTION OF THE DRAWING

Details of the invention will be apparent from the following description and from the accompanying drawing in which.

DESCRIPTION OF THE PREFERRED EMBODIMENT

Figure 1:
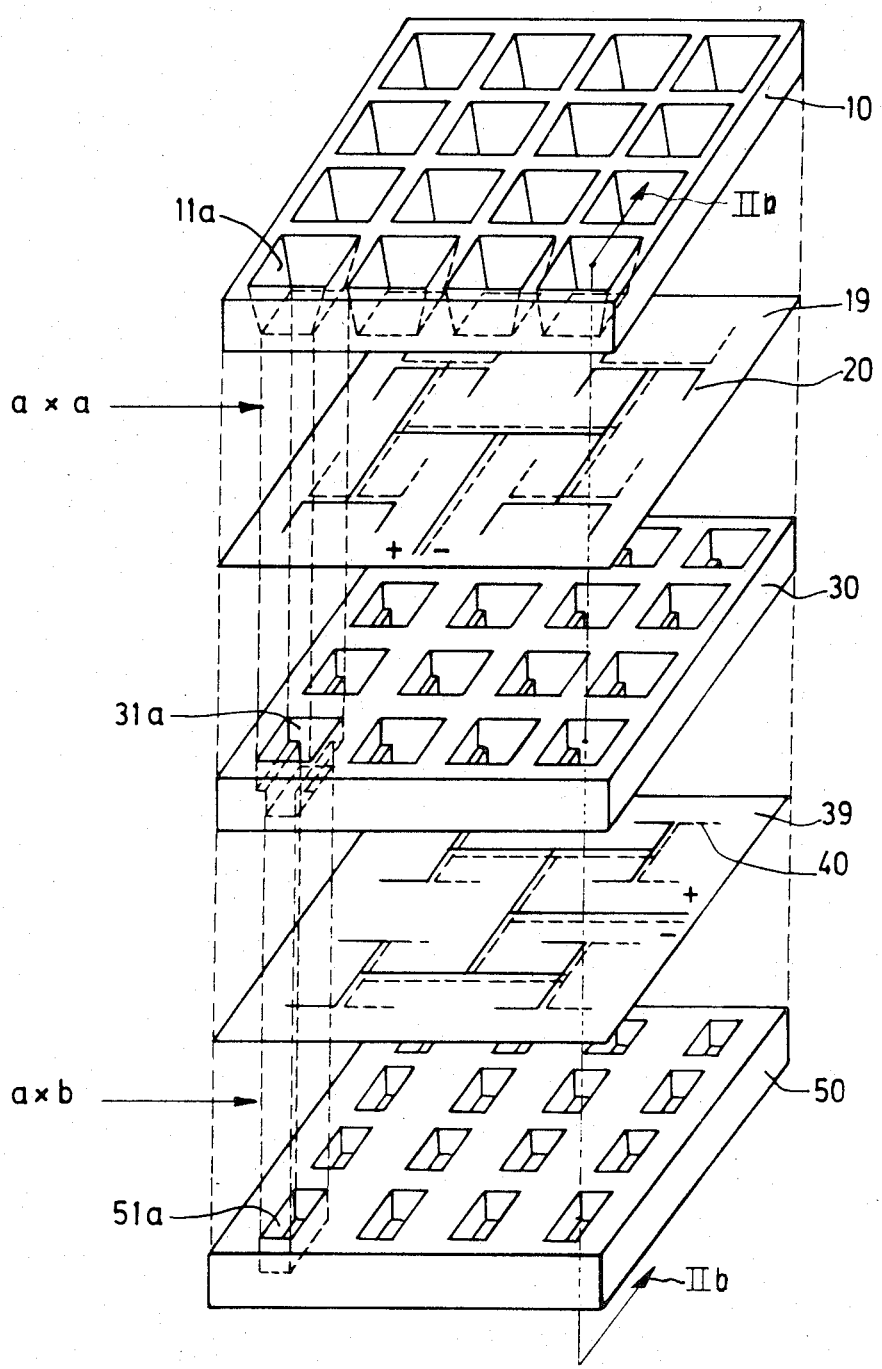
FIG. 1 is a perspective view of an examplary high-frequency planar antenna comprising an array of receiving elements in accordance with the invention.
Figure 2A:
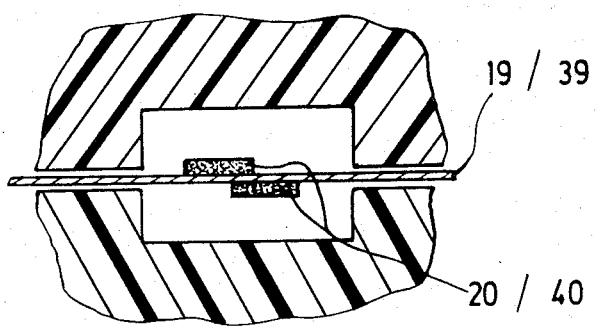
FIG. 2*a* is a cross-sectional view showing the arrangement of the supply networks.
Figure 2B:
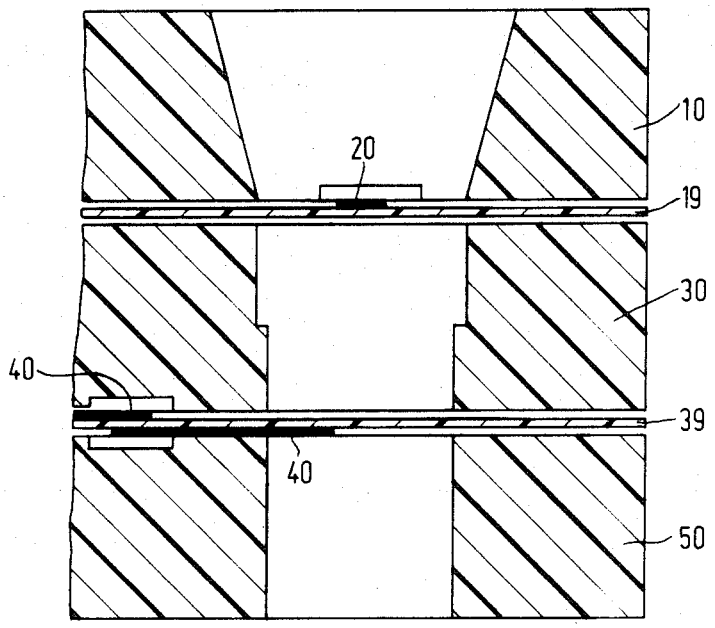
FIG. 2*b* is a cross-sectional view taken along line IIb of FIG. 1.

The embodiment shown in FIGS. 1 and 2*b* is in the form of an antenna which has the following succession of layers:

1. An array of miniature horns 11*a* to 11*n*, each has a square cross-section a x a. The horns are formed by respective flared openings juxtaposed in a first insulating layer 10, each opening being defined by metallized walls. These openings effect guiding of the left-hand or right-hand circularly polarized high-frequency signals which are applied to the antenna at that side of the miniature horns where the cross-section is widest. These horns must be positioned as close as possible to each other. The walls which separate them must be as thin as possible to obtain maximum gain (by maximizing the collective horn area), to prevent mutual coupling between adjacent horns, and to improve matching by reducing unused surfaces which are the source of reflections.

2. A thin dielectric film 19 is provided against the layer 10 at the side where the cross-section a x a of the miniature horns is smallest. Film 19 support conductive transmission lines of a first supply network 20 which is coupled to the waveguides which form these miniature horns to carry high-frequency signals which have a predetermined linear polarization.

3. A second insulating layer 30 includes a second array of miniature waveguides 31*a* to 31*n*, also having metallized walls. Over the first half of their depth, that is to say over a depth of $\lambda_g/4$ ($\lambda_g$ being the wavelength of the signals in the waveguides) each of these miniature waveguides have the same square cross-section a x a as the smallest of the square sections of the miniature horns 11*a* to 11*n*. Over their second half, each of these waveguides has a reduced section a x b of rectangular form, arranged as shown, for example, in FIG. 1, page 379, of the periodical "IEEE Transactions on Microwave Theory and Techniques", 13, No. 3, May 1965 or as described on page 162, column 2, lines 43 to 48 of the periodical "Electronics" of September 1954. The miniature waveguides 31*a* to 31*n*, arranged opposite the miniature horns 11*a* to 11*n* guide received high-frequency signals whose polarization is also linear but perpendicular to the polarization of the signals carried by the first supply network 20.

4. A second dielectric film 39 is provided against the layer 30 at the side of the reduced rectangular section of the miniature waveguides 31*a* to 31*n*. Dielectric film 39 supports conductive lines of a second supply network 40, which is identical to the first supply network but shifted 90° relative thereto. Supply network 40 is coupled to the miniature waveguides 31*a* to 31*n* for carrying high-frequency signals having a linear polarization perpendicular to the polarization of the signals taken from the first network 20.

5. A third insulating layer 50 includes a third array of miniature waveguides 51*a* to 51*n* having metal-plated walls and bottoms and a rectangular cross section equal to the reduced rectangular section a x b of the miniature waveguides 31*a* to 31*n*. The walls of these miniature waveguides 51*a* to 51*n* have a depth of $\lambda_g/4$, and their respective bottoms form reflecting planes situated at an optimum distance from the supply networks 40 and 20.

The two supply networks are each formed from a series of consecutive stages for combining the signals received by the receiving elements, in accordance with a conventional geometrical arrangement such as shown, for example, in FIG. 1 of U.S. Pat. No. 3,587,110, granted on June 22nd, 1971 to the RCA Corporation. Cavities may be provided (see FIG. 2*a*) in the layers adjacent to the supply network plane in order to permit, in accordance with a balanced arrangement such as shown in FIG. 4 of the above-mentioned Patent, the course of the lines of these networks from each of the individual receiving elements of the antenna towards a single output connection for each one of the two networks, while passing through the consecutive stages.

Figure 3A:
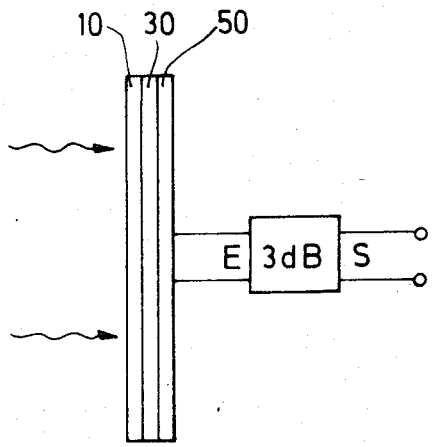
FIGS. 3*a* and 3*b* are two circuit diagrams showing the position of the polariser for obtaining right-hand and left-hand circularly polarized signals.

In order to recover the right-hand and left-hand circularly-polarized signals, a 3 dB hybrid coupler is provided at connected to the outputs of the two supply networks (see FIG. 3*a*). The output connection of one of these networks is connected to one input of the coupler, and the output connection of the other network is connected to another input of the coupler. The two outputs of the coupler produce the right-hand or left-hand circularly polarized signals.

Figure 3B:
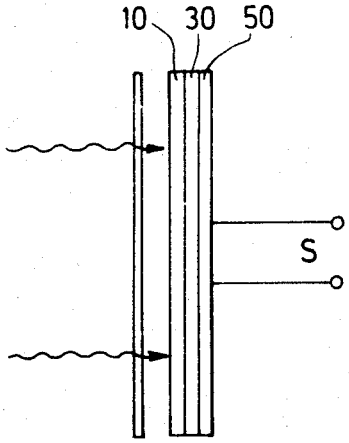

The present invention is not limited to the above-described embodiments, and other variations may be proposed without departing from the scope of the invention. For example, the right-hand or left-hand circularly polarized signals can be obtained not only by using a 3 dB hybrid coupler downstream of the antenna, at the output of the supply networks, but alternatively by means of a polarizer, for example of the known meander type, disposed in front of the antenna as is shown in the circuit diagram of FIG. 3*b*.

What is claimed is:

1. An antenna element for circularly-polarized high-frequency signals, said antenna element comprising, in succession:

a. a relatively thick first layer of insulating material having an opening therethrough defined by conductive side walls which are slanted to form a horn of square cross-section;

b. a relatively thin second layer of insulating material disposed adjacent to one side of the first layer where the horn has its narrowest cross-section, said second layer supporting a conductor oriented relative to the horn to couple signals having a first linear polarization;

c. a relatively thick third layer of insulating material disposed adjacent to the second layer, said third layer having an opening therethrough defined by conductive sidewalls which are stepped to form a first waveguide having two different cross-sectional areas, one end of said first waveguide facing and having the same square cross-section as the horn's narrowest end, and an opposite end of said waveguide having a smaller, rectangular cross-section;

d. a relatively thin fourth layer of insulating material disposed adjacent to the third layer, said fourth layer supporting a conductor oriented relative to the rectangular end of the first waveguide to couple signals having a second linear polarization which is perpendicular to that of said first linear polarization; and e. a relatively thick fifth layer of insulating material disposed adjacent to the fourth layer, said fifth layer having an opening therein defined by conductive sidewalls forming a second waveguide, said opening having a depth smaller than the thickness of the fifth layer, one end of said second waveguide facing and having the same rectangular cross-section as the smaller end of the first waveguide, and an opposite end of said second waveguide being short-circuited.

2. An antenna for circularly-polarized high-frequency signals, said antenna comprising, in succession:

a. a relatively thick first layer of insulating material having a plurality of openings therethrough each defined by conductive side walls which are slanted to form a respective horn of square cross-section;

b. a relatively thin second layer of insulating material disposed adjacent to one side of the first layer where the horns have their narrowest cross-sections, said second layer supporting a network of conductors each oriented relative to a respective one of the horns to couple signals having a first linear polarization;

c. a relatively thick third layer of insulating material disposed adjacent to the second layer, said third layer having a plurality of openings therethrough each defined by conductive sidewalls which are stepped to form a respective waveguide having two different cross-sectional areas, one end of each waveguide facing and having the same square cross-section as a respective horn's narrowest end, and an opposite end of each waveguide having a smaller, rectangular cross-section;

d. a relatively thin fourth layer of insulating material disposed adjacent to the third layer, said fourth layer supporting a network of conductors each oriented relative to the rectangular end of a respective one of the waveguides to couple signals having a second linear polarization which is perpendicular to that of the first linear polarization; and e. a relatively thick fifth layer of insulating material disposed adjacent to the fourth layer, said fifth layer having a plurality of openings therein each defined by conductive sidewalls forming a rectangular waveguide, each opening having a depth smaller than the thickness of the fifth layer, one end of each rectangular waveguide facing and having the same cross-section as the smaller end of a respective waveguide in the third layer, and an opposite end of each rectangular waveguide being short-circuited.

* * * * *